US006039174A

United States Patent [19]

Rogers

[11] Patent Number: 6,039,174

[45] Date of Patent: Mar. 21, 2000

[54] CONTAINER

[76] Inventor: Graham Rogers, Room 618, Star House, 3 Salisbury Road, Tsimshatsui, Kowloon, Hong Kong, The Hong Kong Special Administrative Region of the People's Republic of China

[21] Appl. No.: 09/184,386

[22] Filed: Nov. 2, 1998

[30] Foreign Application Priority Data

Apr. 20, 1998 [GB] United Kingdom ..... 9808329

[51] Int. Cl.[7] ..... A45C 11/04

[52] U.S. Cl. ..... 206/6; 206/1.5; 220/264; 220/315

[58] Field of Search ..... 206/1.5, 5, 6; 220/263, 220/264, 822, 826, 315

[56] References Cited

U.S. PATENT DOCUMENTS

| | | | |
|---|---|---|---|
| 663,647 | 12/1900 | Wells | 206/6 |
| 2,371,557 | 3/1945 | Sullivan | 206/6 |
| 2,670,842 | 3/1954 | Kruft | 220/826 |
| 3,784,046 | 1/1974 | Cata | 220/826 |
| 4,200,197 | 4/1980 | Meyer et al. | 220/263 |
| 5,213,226 | 5/1993 | Nichols | 220/263 |
| 5,261,582 | 11/1993 | Mathews et al. | 206/5 |
| 5,615,765 | 4/1997 | Roericht | 206/6 |
| 5,711,417 | 1/1998 | Tilve | 206/6 |

FOREIGN PATENT DOCUMENTS

| | | | |
|---|---|---|---|
| 0 609 467 | 8/1994 | European Pat. Off. . | |
| 13898 | 6/1881 | Germany | 220/264 |
| 452692 | 8/1936 | United Kingdom . | |

*Primary Examiner*—Paul T. Sewell
*Assistant Examiner*—Jila Mohandesi
*Attorney, Agent, or Firm*—Merchant & Gould P.C.

[57] ABSTRACT

A container for carrying spectacles or the like is formed as an elongate case 1 having jaw members 2,3 at one end thereof for opening and closing the case 1. A single control button 4 is provided which is operatively connected to jaw moving means such that when the case 1 is open operation of the button 4 causes the jaw members 2,3 to close, while when the case 1 is closed, operation of the button 4 causes the jaw members 2,3 to open. This is achieved by the fact that the jaw members are acted upon by urging means that respectively act to open or close the case 1, one of the urging means being the stronger, and that upon operation of the button 4 the stronger of urging means is alternately engaged and disengaged.

27 Claims, 6 Drawing Sheets

Figure 1:
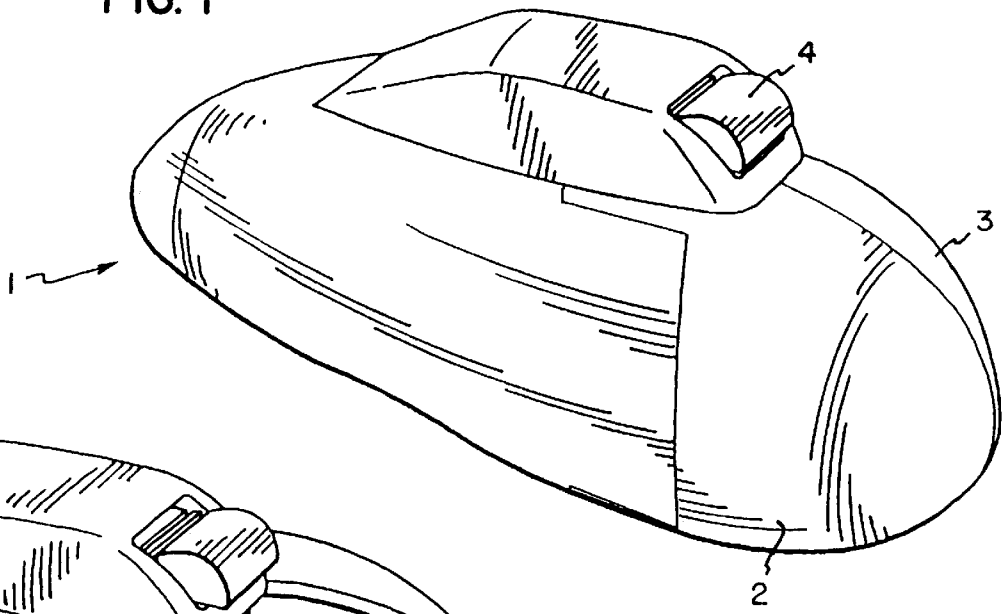

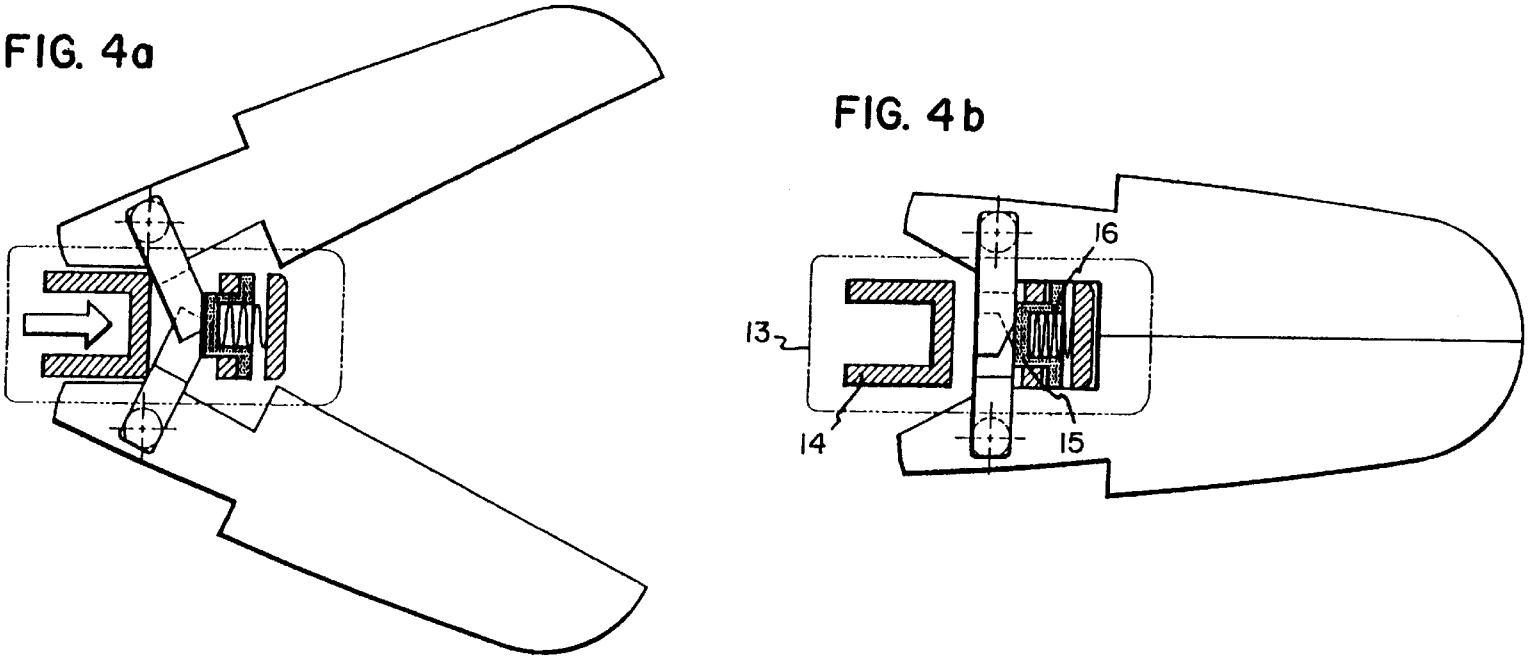
FIG. 4b
FIG. 4a
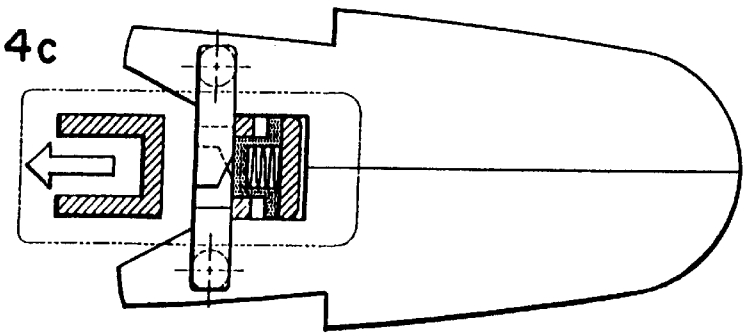
FIG. 4c

CONTAINER

This invention relates to a container, and in particular to a container for storing and carrying small items such as spectacles, sun glasses and the like.

A wide variety of containers have been designed over the years to fulfill a number of roles. Containers may be designed to receive small items or large items; solid items or liquid items. Containers may be kept air-tight or liquid-tight, or this may not be an issue. Containers may be in the form of a "one-off" receptacle designed to be disposed off after use, or may be designed for repeated use.

One known type of container is the spectacle case. This may be characterised as a small, relatively lightweight container which however has the strength to protect its contents and which can be opened and closed for repeated use. Here it should also be noted that while for convenience the remainder of this specification will refer to the term "spectacle case", the invention is not necessarily limited thereto and may be applied to similar containers for receiving like items, such as for example: sunglasses, items of jewelry, watches and so on.

A conventional spectacle case is in the form of a rigid box generally of the same proportions (but of course slightly larger) than a pair of spectacles, and having a spring-loaded lid that may be opened and closed to allow spectacles to be placed in and taken out of the case. As such the conventional spectacle case has served the public well over the years, but there remains a need to provide a more versatile and convenient form of spectacle case.

According to the present invention there is provided a container for carrying spectacles or the like and being adapted to be held by a user in one hand and comprising means for opening and closing said container, said opening and closing means being operable by a single control button whereby when said container is closed pressing said button causes said container to be opened to define an opening having dimensions substantially corresponding to a cross-section of the container and permitting access to the interior of the entire container, and whereby when said container is open pressing said button causes said container to be closed.

By means of this arrangement a particularly convenient form of container can be provided which can be held in one hand and which can be opened and closed by the pressing of one single button—the same action causing respectively opening or closing of the container depending on its current condition—which button may be pressed by a finger or thumb on the hand that is holding the container. When the container is open the opening is of substantially the same size as the container cross-section itself which allows maximum access to the container so that the space of the container can be fully utilised with ease.

In a preferred embodiment the container is generally elongate and at one end is provided with a pair of jaw members, said jaw members having a first position in which they are brought together to close the container, and a second position in which they are moved apart to open the container, and means are provided to move said jaw members between said first and second positions upon operation of said button.

In a preferred arrangement the jaw member moving means comprises means for urging said jaw members towards a closed position, and means for urging said jaw members towards an open position, a first of said urging means being of greater force than the second urging means so as to normally bias said jaw members into either an open or a closed position, and means being provided upon operation of said button to disengage said first urging means.

In a particularly preferred embodiment the button is operatively connected to a housing on which are provided said first and second urging means and first and second spring means are provided associated with respective said urging means, one of said springs being of greater force than the other so as to bias said jaw members either open or closed, and means being provided for disengaging the stronger of said urging means upon operation of said button and for re-engaging said stronger of said urging means upon repeated operation of said button.

Preferably said disengaging and re-engaging means comprises a locking member movable upon operation of said button back and forth between a first position in which the stronger of said urging means is allowed to act on said arms, and a second position in which said stronger of said urging means is disengaged.

The locking member may be provided with a pawl at one end thereof which is guided between said first and second positions by guide surfaces.

Preferably the jaw members are normally biased into an open position.

Preferably the jaw members are pivotally mounted to the container and are provided with respective arms, said jaw member moving means being caused upon operation of said button to act upon said arms to cause pivoting opening or closing movement of said jaw members so as to open or close said container.

Although ideally suited to small hand-held containers, in principle the present invention need not be so limited and could also be applicable to any form of container which may be opened and closed by repeated pressing of a single actuating button.

For example, the present invention may also extend to a container having opening and closing means, said opening and closing means having first spring means urging said opening and closing means into an open position, and second spring means for urging said opening and closing means into a closed position, one of said first and second spring means being stronger than the other so as to normally bias the opening and closing means into an open or closed position, and means for alternately engaging and disengaging said stronger of said spring means upon repeated operation of said opening and closing means.

Figure 2:
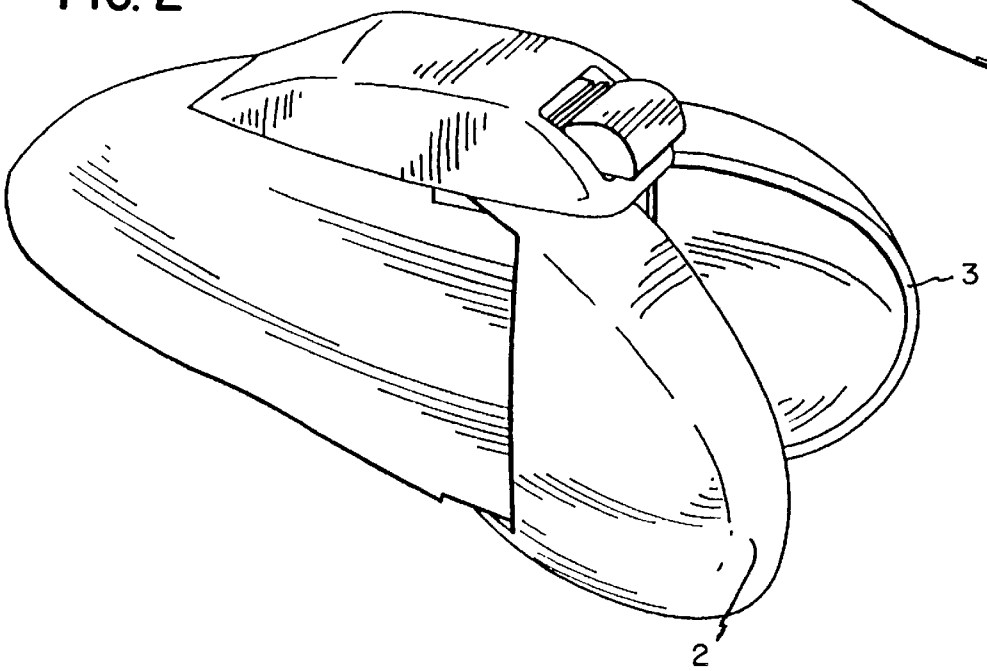
Figure 3A:
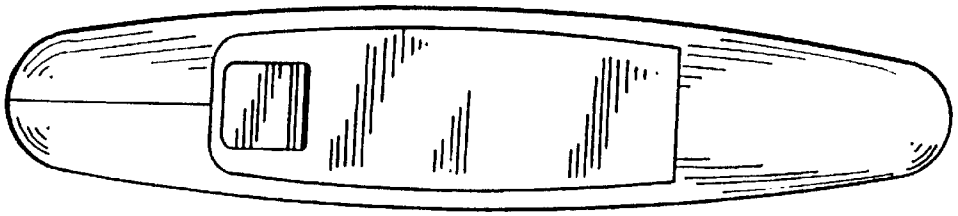
Figure 3B:
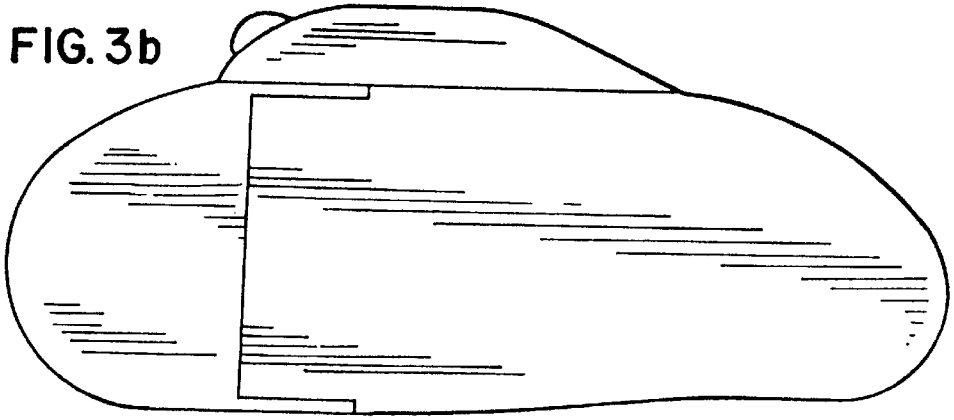
Figure 3C:
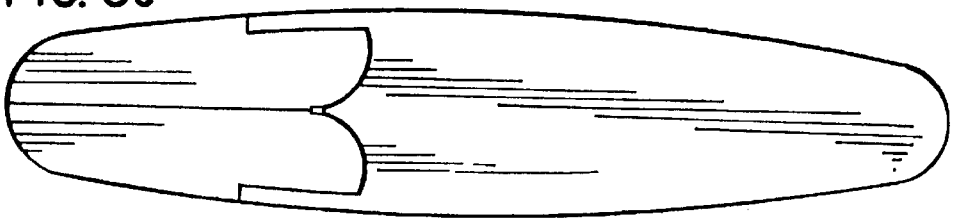
Figure 5:
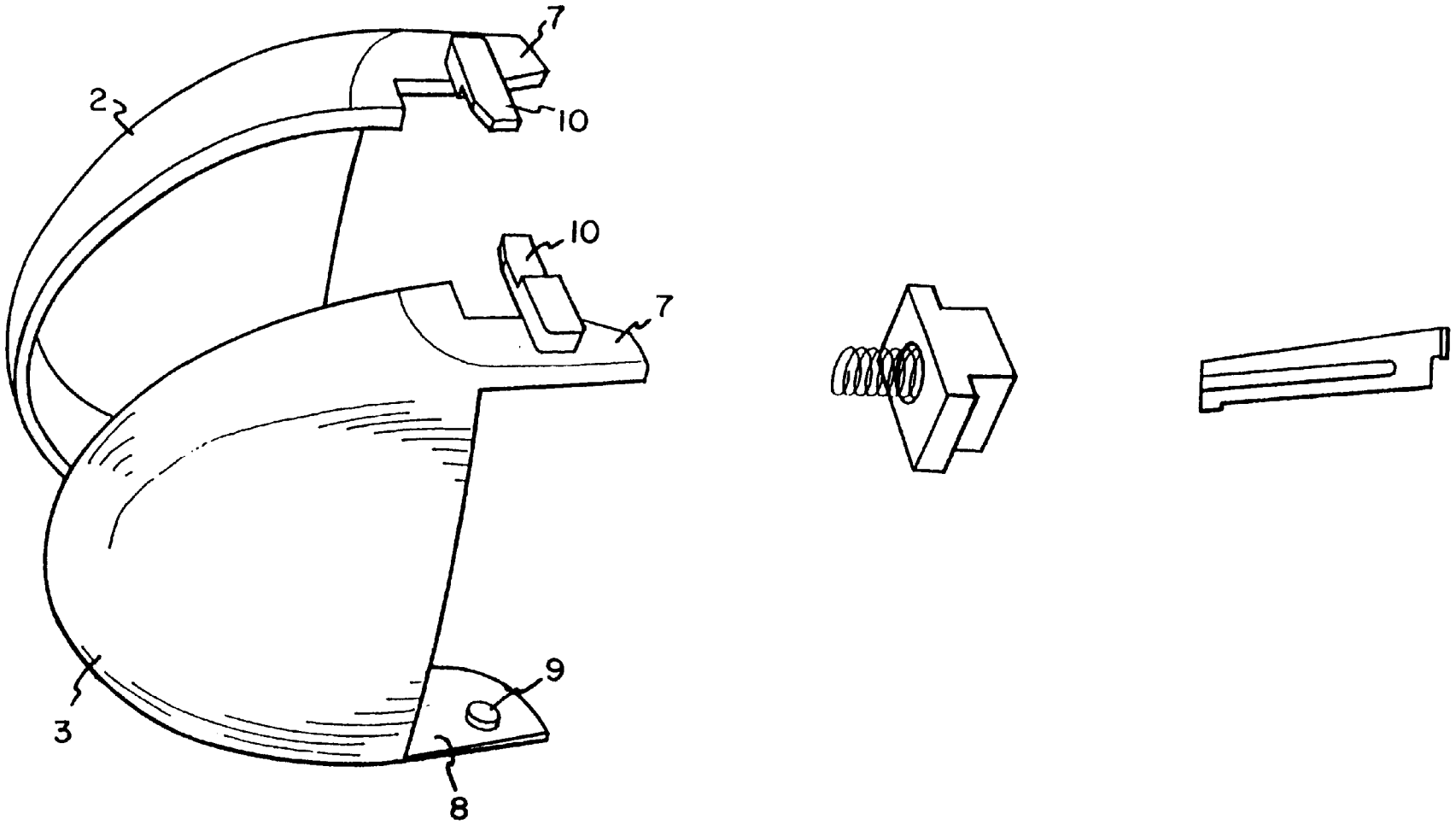
Figure 6A:
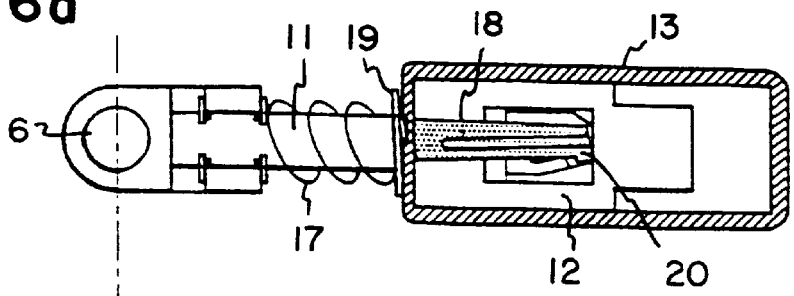
Figure 6B:
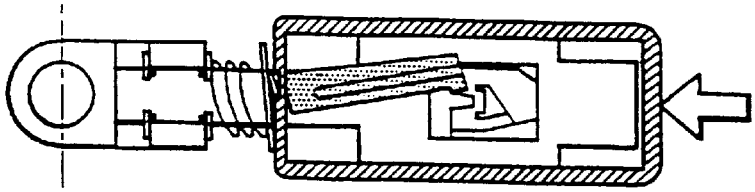
Figure 6C:
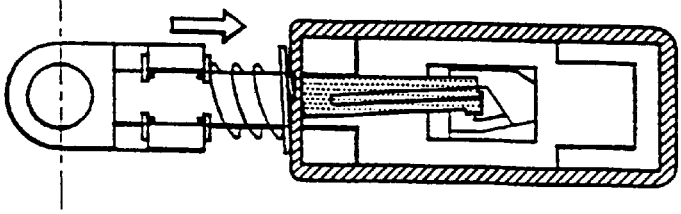
Figure 6D:
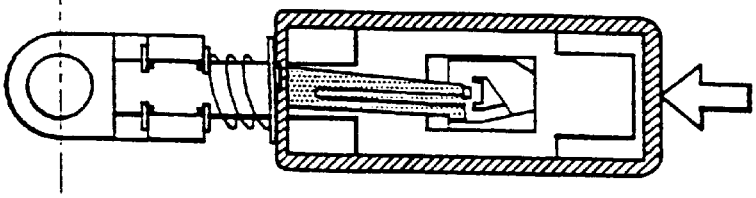
Figure 6E:
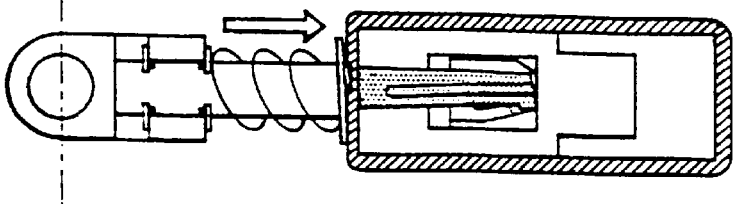
Figure 7A:
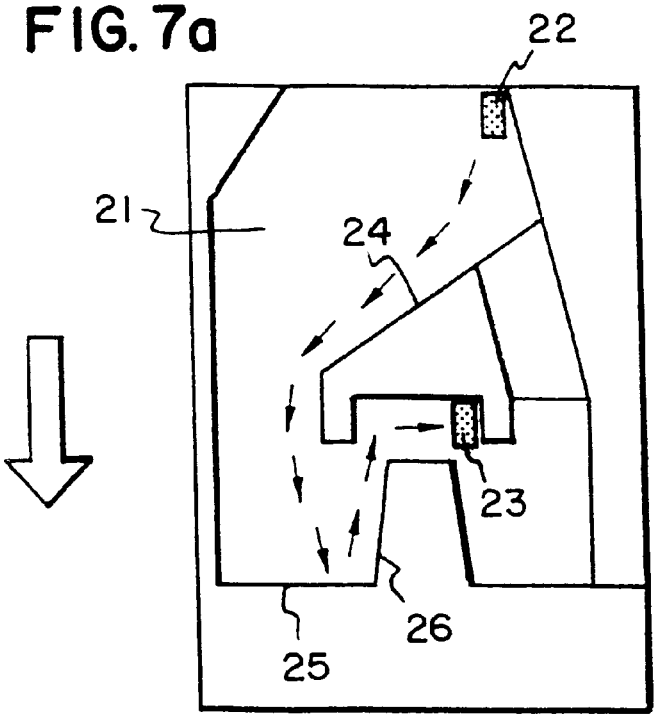
Figure 7B:
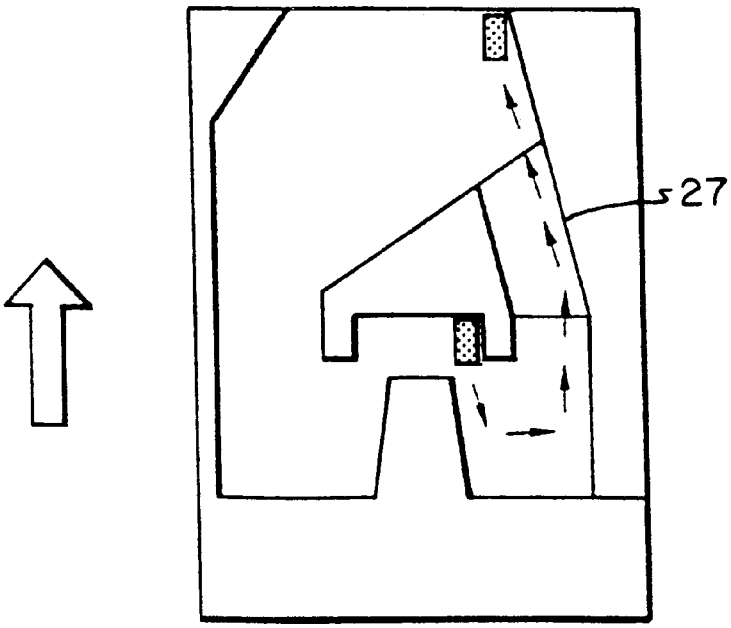

An embodiment of the invention will now be described by way of example and with reference to the accompanying drawings, in which:

FIG. 1 is a perspective view of a container according to an embodiment of the invention in a closed condition, FIG. 2 is a view corresponding to FIG. 1 but in an open condition, FIGS. 3(*a*)–(*c*) are top, side and bottom views of the container of FIG. 1 all in the closed position, FIGS. 4(*a*)–(*c*) are sectional views through the jaw members of the embodiment of FIG. 1 showing their opening and closing, FIG. 5 is a perspective exploded view showing the jaw members, FIGS. 6(*a*)–(*e*) are sectional views showing operation of the opening and closing member, and FIGS. 7(*a*)&(*b*) show the path of movement of the pawl of the locking member.

Referring firstly to FIGS. 1 and 2 there is shown a container according to an embodiment of the invention in the form of a spectacle case 1. The case 1 comprises a generally elongate body just large enough to receive therein a pair of spectacles or sunglasses and also of a size so that it can be comfortably received within the palm of one hand.

At one end—designated for convenience a front end—there is provided a pair of jaw members 2,3 which come together to close the case 1 (as shown in FIG. 1) but which may moved apart to open the case 1 (FIG. 2) in order to allow access to the interior to take out or put in a pair of spectacles or sunglasses.

The opening and closing of the jaw members 2,3 is controlled by the operation of a single button 4 which is located at the front of a control housing 5 formed on a top part of the spectacle case 1. As will be explained below, this single button 4 controls both the opening and closing of the jaw members 2,3. That is to say when the jaw members 2,3 are in the closed condition of FIG. 1 pressing button 4 will cause them to move into the open position of FIG. 2, while when the jaw members 2,3 are in the open position of FIG. 2 pressing button 4 will cause them to move into the closed position of FIG. 1.

Thus by means of the operation of a single button 4 the spectacle case 1 can be repeatedly opened and closed, and indeed since this opening is effected by the operation of just a single button 4, the case 1 can be opened and closed using only a single hand. The case 1 is held in the palm of the hand and is operated by pressure from the thumb acting on the button 4.

FIGS. 4(*a*)–(*c*) show the jaw members 2,3 in their various positions, while FIG. 5 shows the jaw members in an exploded perspective view. Referring to FIG. 5 in particular it will be seen that each jaw member 2,3 comprises upper 7 and lower 8 flange members which extend from the end of the jaw members 2,3 that in use are adjacent the body of the case 1. The lower flange members 8 are provided with respective upstanding pins 9 that allow the jaw members 2,3 to pivot about pins 9 between their open and closed positions. Extending inwardly from the upper flange members 7 are arms 10 which are acted upon in use to cause pivoting of the jaw members in a manner to be described below. A comparison of FIGS. 4(*b*) and (*c*) shows that a small displacement of the housing 13 is allowed as the button is pressed inwardly. This corresponds to the small distance that the button 4 is pressed inwardly before the opening and closing mechanism to be described below comes into play. The opening and closing of the jaws will now be described with particular reference to FIGS. 4, 6 and 7.

FIGS. 6(*a*)–(*e*) show the relative positions of the opening mechanism when: (a) the jaws are open; (b) the button 4 is pressed inwardly to close the jaws; (c) the jaws are closed; (d) the button 4 is pressed again to open the jaws; and (e) the jaws are once more in their open position.

Secured to a fixed point 6 on the body of the case 1 is an elongate member 11 a distal portion 12 of which is widened and is received within a housing 13 operatively connected to button 4. On the underside of housing 13 is formed a jaw opening member 14 best seen in FIGS. 4(*a*)–(*c*). As can be seen from FIG. 4(*a*), when the housing 13 is moved to the right as viewed in that figure, the jaw opening member 14 acts upon the jaw members 2,3 so as to urge them apart to open the case. Acting on the jaw members 2,3 in the opposite sense is a jaw closing member 15 also formed on the underside of the housing 13 and which is normally urged by a spring 16 to act on the jaw members 2,3 so as to move them together to close the case.

Returning to FIGS. 6(*a*)–(*e*) it will be seen that a spring 17 is provided between the fixed point 6 and the housing 13 and acts to urge the housing 13 to the right as viewed in the figures. Thus it will be appreciated that springs 16 and 17 are acting in an opposite sense. Spring 16 acts to urge the jaw members closed and spring 17 acts to urge the jaw members open. Spring 17 is stronger than spring 16 and so normally the jaw members 2,3 are spring-biased towards their open position. To close the jaw members 2,3 it is thus necessary to allow the spring 16 to overcome the spring 17 and this is achieved by means of locking member 18.

Locking member 18 comprises an elongate metal strip fixed at one end between a plate 19 located at an end of the housing 13 and upon which bears spring 17, and between an end wall of the button 4 (not shown in FIG. 6). The other end of the locking member is formed with a locking pawl 20. As is seen most clearly in FIGS. 7(*a*)&(*b*) the locking pawl engages with a contoured surface 21 provided on the top surface of the enlarged portion 12 of the elongate member 11. As can be seen from FIGS. 7(*a*)&(*b*) in particular, the locking pawl 20 can be moved between two positions: a first position 22 in which the locking member 18 allows the spring 17 to act fully and in turn the spring 17 causes the jaw opening member 14 to act on the jaw members 2,3 so as to cause them to open; and a second position 23 in which the locking member 18 causes the housing to be held to the left (FIG. 6(*c*)) in a position in which the jaw opening member 14 does not act on the arms and thus the spring 16 takes precedence to cause the jaw members 2,3 to close.

The operation of the opening and closing of the case 1 will now be described, beginning with the case 1 being open as shown in FIG. 6(*a*). In this position the locking pawl 20 is in the first position 22 (FIG. 7(*a*)) which allows the spring 17 to act on the housing 13 to push it towards the right and in turn this causes the jaw opening member 14 to engage arms 10 and cause the jaw members 2,3 to open against the action of spring 16 since spring 17 is stronger than spring 16. To close the jaw members 2,3 the button 4 is pressed in which causes the housing 13 to move to the left and to compress spring 17 (see FIG. 6(*b*)). The locking member 18 moves to the left with the housing and the pawl 20 follows the path indicated by the broken line in FIG. 7(*a*) following sloping wall 24 until it reaches back wall 25, at which point the housing 13 moves slightly to the right (FIG. 6(*c*)) and pawl 20 follows wall 26 until it reaches its second position 23.

In this position—the position of FIG. 6(*c*)—the housing is held in a position in which the jaw opening member 14 is disengaged from the arms 10 of the jaw members 2,3, and therefore spring 16 takes over to cause the arms 10 to pivot into a closed position of the jaw members 2,3. The case is therefore closed and is held closed by spring 16. To open the case once more the button 4 is pressed again (FIG. 6(*d*)) and the locking pawl 20 moves from the second position 23 to the first position 22 following the broken line in FIG. 7(*b*) and being guided by the side wall 27. When the pawl 20 is in the first position 22 the locking member 18 moves to the position of FIG. 6(*e*) and the jaw opening member 14 acts upon the arms 10 and through spring 17 overcomes spring 16 and causes the arms to pivot apart and thus the jaw members 2,3 to move to their open position. It will be noted that when the jaw members 2,3 are in their open position they define an opening into the container that is the same size as the cross-sectional width of the container itself. This permits maximum access to the interior of the container when it is open and thus maximises its possible use.

Thus by repeated pressing of the button 4 the jaw members 2,3 can alternately be caused to open and close and thus the case can be opened and closed in a particularly simple and effective manner using just one button which can be operated, for example, by the thumb of a user holding the spectacle case in the palm of one hand. Although described above with reference to a spectacle case, it will be appreciated that the container could have many possible uses. One possibility, for example, would be as a portable ash tray. A user could carry the container/ash tray with them and when they were smoking could use the container to receive ash. The container could then be emptied later at home.

What is claimed is:

1. A container for carrying items, comprising means for opening and closing the container, said opening and closing means being operable by a single control button whereby when the container is closed pressing said button causes the container to be opened to define an opening having dimensions substantially corresponding to a cross-section of the container and permitting access to the interior of the container, and whereby when the container is open pressing said button causes the container to be closed.

2. A container as claimed in claim 1 wherein the container is generally elongate and at one end is provided with a pair of jaw members, said jaw members having a first position in which they are brought together to close the container, and a second position in which they are moved apart to open the container, and means are provided to move said jaw members between said first and second positions upon operation of said button.

3. A container as claimed in claim 2 wherein the jaw member moving means comprises means for urging said jaw members towards said closed position, and means for urging said jaw members towards said open position, a first of said urging means being of greater force than the second of said urging means so as to normally bias said jaw members into an open or closed position, and means being provided to alternately engage and disengage said first urging means upon operation of said button.

4. A container as claimed in claim 3 wherein the button is operatively connected to a housing on which are provided said first and second urging means and first and second spring means are provided associated with respective said urging means, one of said springs being of greater force than the other so as to bias said jaw members either open or closed.

5. A container as claimed in claim 3 wherein said disengaging and re-engaging means comprises a locking member movable upon operation of said button back and forth between a first position in which the stronger of said urging means is engaged and a second position in which the stronger of said urging means is disengaged.

6. A container as claimed in claim 5 wherein said locking member is provided with a pawl at one end thereof and which is guided between said first and second positions by guide surfaces.

7. A container as claimed in claim 3 wherein said jaw members are normally biased in an open position.

8. A container as claimed in claim 2 wherein said jaw members are pivotally mounted to the container and are provided with respective arms, said jaw member moving means being caused upon operation of said button to act upon said arms to cause pivoting opening or closing movement of said jaw members so as to open or close the container.

9. A container as claimed in claim 4 wherein said disengaging and re-engaging means comprises a locking member movable upon operation of said button back and forth between a first position in which the stronger of said urging means is engaged and a second position in which the stronger of said urging means is disengaged.

10. A contained as claimed in claim 9 wherein said locking member is provided with a pawl at one end thereof and which is guided between said first and second positions by guide surfaces.

11. A container as claimed in claim 4, wherein said jaw members are normally biased in an open position.

12. A container as claimed in claim 5, wherein said jaw members are normally biased in an open position.

13. A container as claimed in claim 6, wherein said jaw members are normally biased in an open position.

14. A container as claimed in claim 9, wherein said jaw members are normally biased in an open position.

15. A container as claimed in claim 10, wherein said jaw members are normally biased in an open position.

16. A container as claimed in claim 3 wherein said jaw members are pivotally mounted to the container and are provided with respective arms, said jaw member moving means being caused upon operation of said button to act upon said arms to cause pivoting opening or closing movement of said jaw members so as to open or close the container.

17. A container as claimed in claim 4 wherein said jaw members are pivotally mounted to the container and are provided with respective arms, said jaw member moving means being caused upon operation of said button to act upon said arms to cause pivoting opening or closing movement of said jaw members so as to open or close the container.

18. A container as claimed in claim 5 wherein said jaw members are pivotally mounted to the container and are provided with respective arms, said jaw member moving means being caused upon operation of said button to act upon said arms to cause pivoting opening or closing movement of said jaw members so as to open or close the container.

19. A container as claimed in claim 6 wherein said jaw members are pivotally mounted to the container and are provided with respective arms, said jaw member moving means being caused upon operation of said button to act upon said arms to cause pivoting opening or closing movement of said jaw members so as to open or close the container.

20. A container as claimed in claim 7 wherein said jaw members are pivotally mounted to the container and are provided with respective arms, said jaw member moving means being caused upon operation of said button to act upon said arms to cause pivoting opening or closing movement of said jaw members so as to open or close the container.

21. A container as claimed in claim 9 wherein said jaw members are pivotally mounted to the container and are provided with respective arms, said jaw member moving means being caused upon operation of said button to act upon said arms to cause pivoting opening or closing movement of said jaw members so as to open or close the container.

22. A container as claimed in claim 10 wherein said jaw members are pivotally mounted to the container and are provided with respective arms, said jaw member moving means being caused upon operation of said button to act upon said arms to cause pivoting opening or closing movement of said jaw members so as to open or close the container.

23. A container as claimed in claim 11 wherein said jaw members are pivotally mounted to the container and are provided with respective arms, said jaw member moving means being caused upon operation of said button to act upon said arms to cause pivoting opening or closing movement of said jaw members so as to open or close the container.

24. A container as claimed in claim 12 wherein said jaw members are pivotally mounted to the container and are provided with respective arms, said jaw member moving means being caused upon operation of said button to act upon said arms to cause pivoting opening or closing movement of said jaw members so as to open or close the container.

25. A container as claimed in claim 13 wherein said jaw members are pivotally mounted to the container and are provided with respective arms, said jaw member moving means being caused upon operation of said button to act upon said arms to cause pivoting opening or closing movement of said jaw members so as to open or close the container.

26. A container as claimed in claim 14 wherein said jaw members are pivotally mounted to the container and are provided with respective arms, said jaw member moving means being caused upon operation of said button to act upon said arms to cause pivoting opening or closing movement of said jaw members so as to open or close the container.

27. A container as claimed in claim 15 wherein said jaw members are pivotally mounted to the container and are provided with respective arms, said jaw member moving means being caused upon operation of said button to act upon said arms to cause pivoting opening or closing movement of said jaw members so as to open or close the container.

* * * * *